US007159725B1

(12) United States Patent
Gates et al.

(10) Patent No.: US 7,159,725 B1
(45) Date of Patent: Jan. 9, 2007

(54) BALLOON HOLDING ASSEMBLY

(76) Inventors: James P. Gates, 1021 14th Ave., Middletown, OH (US) 45044; Pamela J. Gates, 1021 14th Ave., Middletown, OH (US) 45044

( * ) Notice: Subject to any disclaimer, the term of this patent is extended or adjusted under 35 U.S.C. 154(b) by 222 days.

(21) Appl. No.: 10/762,751

(22) Filed: Jan. 23, 2004

(51) Int. Cl.
*A47F 5/08* (2006.01)

(52) U.S. Cl. ..... 211/13.1; 211/85.31; 211/182; 312/6; 312/130; 312/265.1

(58) Field of Classification Search ..... 211/13.1, 211/181.1, 85, 85.17, 85.31; 403/170, 171, 403/169; 312/6, 130, 265.1; 206/315.9, 206/443; 248/512, 68.1; 135/121, 122, 135/128, 143, 144; 47/45; 119/452, 472
See application file for complete search history.

(56) References Cited

U.S. PATENT DOCUMENTS 1,588,282 A * 6/1926 Wachsman ..... 119/461
1,865,533 A * 7/1932 Lutzke ..... 220/485
2,839,320 A * 6/1958 Hill ..... 403/172
2,936,771 A * 5/1960 Marchfield et al. ..... 135/148
3,608,903 A 9/1971 Cooper
4,045,104 A * 8/1977 Peterson ..... 312/265.4
4,743,040 A 5/1988 Breveglieri et al.
4,953,713 A 9/1990 Yaffee
5,016,848 A * 5/1991 Metz ..... 248/176.1
5,199,572 A 4/1993 Abe
5,560,502 A * 10/1996 Hsiung ..... 211/195
5,564,575 A 10/1996 Casement
5,617,962 A 4/1997 Chen
5,636,480 A 6/1997 Lauritson et al.
5,727,700 A * 3/1998 Digney ..... 211/119
5,850,988 A 12/1998 Aurilio et al.
5,920,927 A * 7/1999 Thomas ..... 4/599
6,470,515 B1 * 10/2002 Hsia ..... 5/99.1
6,823,883 B1 * 11/2004 Sears ..... 135/128

* cited by examiner

*Primary Examiner*—Richard E. Chilcot, Jr.
*Assistant Examiner*—Jared W. Newton

(57) ABSTRACT

A balloon holding assembly includes a bottom support and an upper support each having a top side and a bottom side. A plurality of elongated vertical supports each has an upper end and a lower end. A plurality of couplers is attached to each of the upper and bottom supports for removably coupling each of the upper ends to a bottom side of the upper support and the lower ends to the top side of the bottom support. A cage is removably positionable over the upper support and extends downwardly from the upper support. Helium filled balloons may be positioned in the cage such that the horizontal wall prevents the balloons from floating upwardly away from the frame.

7 Claims, 3 Drawing Sheets

BALLOON HOLDING ASSEMBLY

BACKGROUND OF THE INVENTION

1. Field of the Invention

The present invention relates to balloon holding devices and more particularly pertains to a new balloon holding device for holding a plurality of helium filled balloons to prevent their escape.

2. Description of the Prior Art

The use of balloon holding devices is known in the prior art. U.S. Pat. No. 5,199,572 describes a bag of netting adapted for holding a plurality of helium filled balloons. Another type of balloon holding device is U.S. Pat. No. 5,727,700 having a suspended cage which is hung from a ceiling and has an open bottom side for receiving and holding a plurality of helium filled balloons. Yet another type of balloon holding device is found in U.S. Pat. No. 4,953,713 which is adapted for holding a plurality of tethers which are each attached to a helium filled balloon.

While these devices fulfill their respective, particular objectives and requirements, the need remains for a device that may be assembled where required for holding a plurality of helium filled balloons. Such a device should be adapted for storing the balloons without any difficulties associated with bags or other apparatuses which require time consuming means of placement and retrieval of the balloons once they are filled with helium.

SUMMARY OF THE INVENTION

The present invention meets the needs presented above by providing a frame that may be assembled where required and supports a cage for holding a plurality of helium filled balloons. The cage allows for the convenient placement and retrieval of the balloons once they are filled with helium.

To this end, the present invention generally comprises a first rectangular shaped loop member defining a bottom support and a second rectangular shaped loop member defining an upper support. Each of the upper and bottom supports has a top side and a bottom side. A plurality of elongated vertical supports each has an upper end and a lower end. A plurality of couplers is attached to each of the upper and bottom supports for removably coupling each of the upper ends to a bottom side of the upper support and the lower ends to the top side of the bottom support such that the upper support is spaced from and positioned over the bottom support. A cage includes a horizontal wall and a perimeter wall that is attached to and extends downwardly from the horizontal wall. The horizontal wall has a size and shape adapted for abutting the upper support such that the upper support is positioned within cage. Helium filled balloons may be positioned in the cage such that the horizontal wall prevents the balloons from floating upwardly away from the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
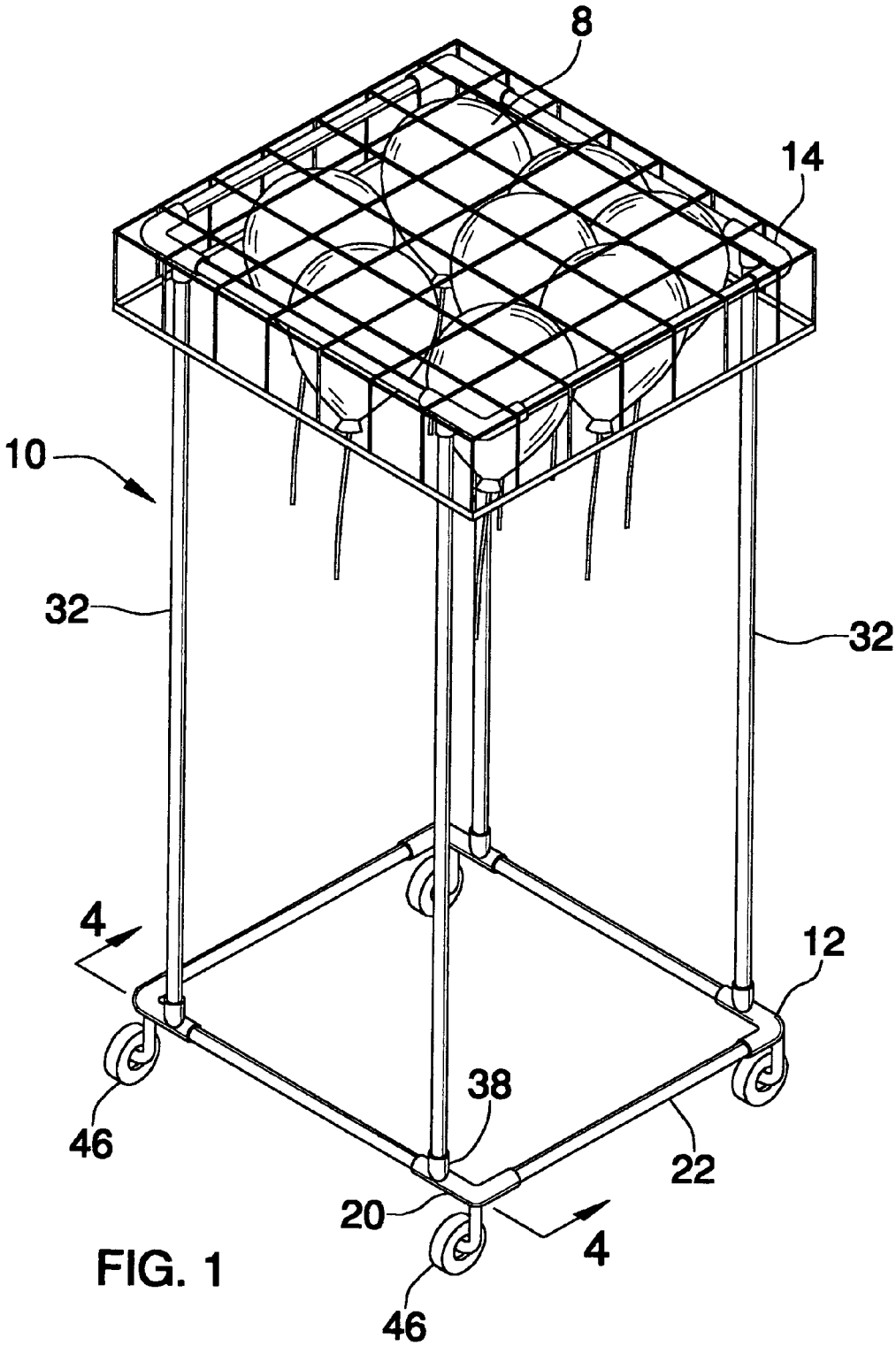
FIG. 1 is a schematic perspective view of a balloon holding assembly according to the present invention.
Figure 2:
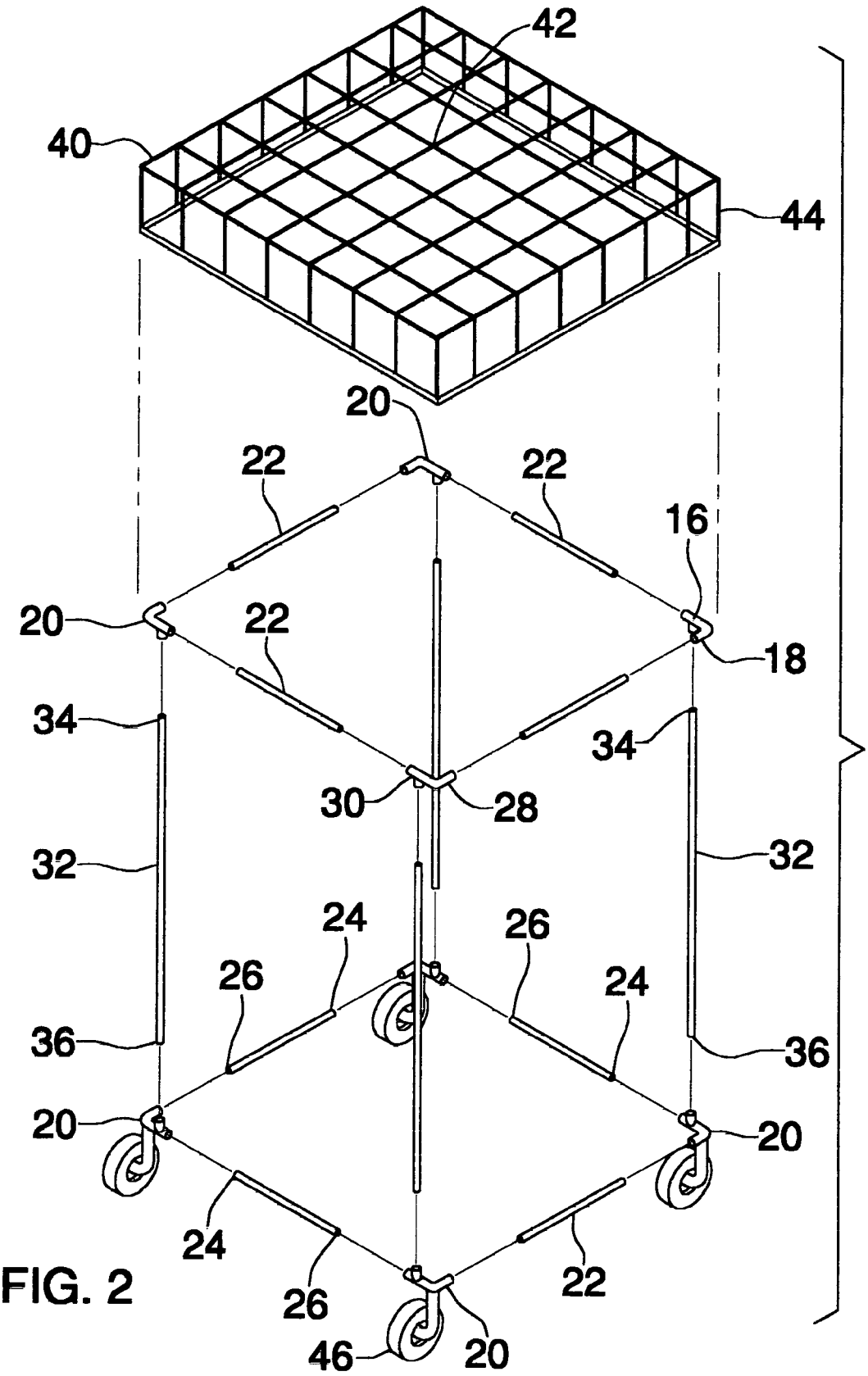
FIG. 2 is a schematic perspective view of the present invention.

With reference now to the drawings, and in particular to FIGS. 1 through 4 thereof, a new balloon holding device embodying the principles and concepts of the present invention and generally designated by the reference numeral 10 will be described.

As best illustrated in FIGS. 1 through 4, the balloon holding assembly 10 generally comprises a first rectangular shaped loop member that defines a bottom support 12 and a second rectangular shaped loop member that defines an upper support 14. Each of the upper 14 and bottom 12 supports has a top side 16 and a bottom side 18. Each of the top 14 and bottom 12 supports includes four corner members 20 and four connectors 22 for removably coupling together adjacent ones of the corner members 20 in a spaced relationship to each other. The connectors 22 each preferably comprise an elongated tubular member having a first end 24 and a second end 26. Each of the corner members 20 includes a first female coupler 28 and a second female coupler 30. Attached ones of the first 28 and second 30 female couplers are orientated generally perpendicular to each other. Each of the first 28 and second 30 female couplers has a size and shape adapted for removably receiving one of the first 24 or second 26 ends of the connectors 22.

Figure 3:
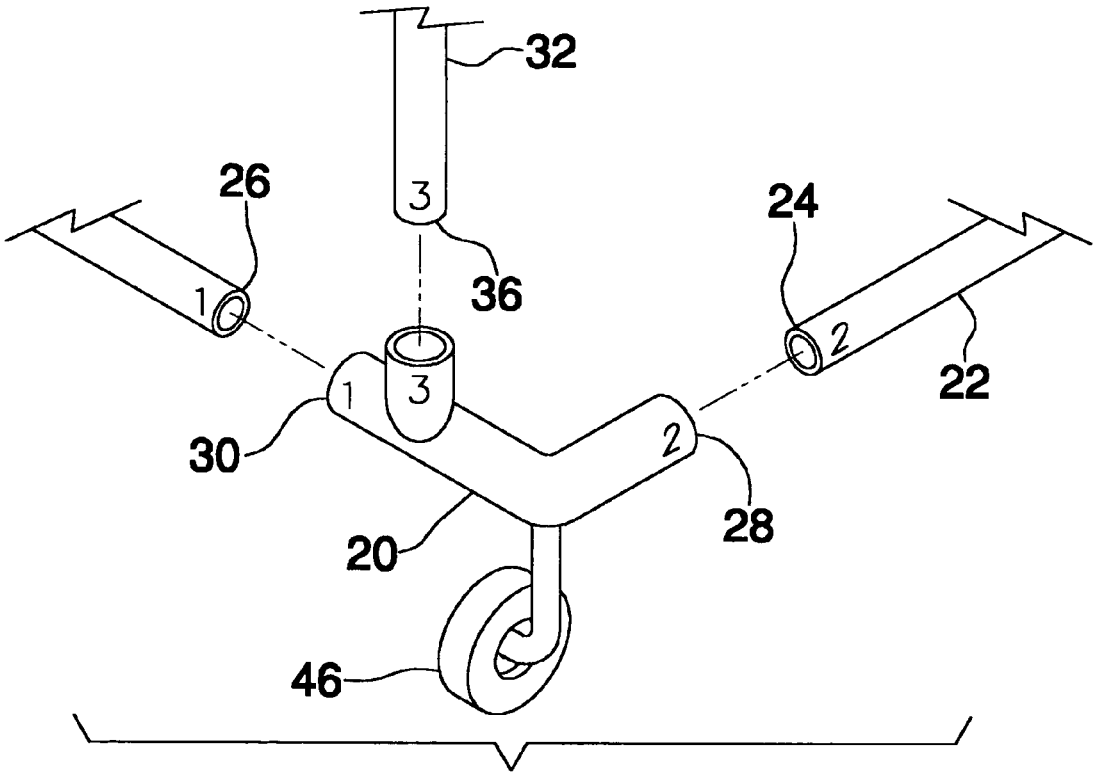
FIG. 3 is a schematic perspective view of the present invention.
Figure 4:
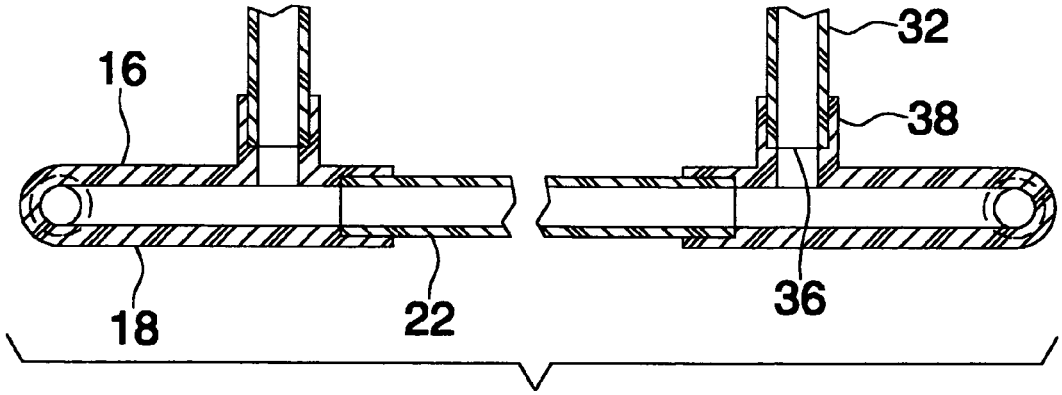
FIG. 4 is a schematic cross-sectional view taken along line 4—4 of FIG. 1 of the present invention.

A plurality of elongated vertical supports 32 is provided. Each of the supports 32 has an upper end 34 and a lower end 36. The vertical supports 32 each have a height greater than 4 feet. A plurality of couplers 38 are attached to each of the upper 14 and bottom 12 supports for removably coupling each of the upper ends 34 to a bottom side 18 of the upper support 14 and the lower ends 36 to the top side 16 of the bottom support 12 such that the upper support 14 is spaced from and positioned over the bottom support 12. Each of the couplers 38 is attached to an associated one of the corner members 20 such that each of the corner members 20 has one of the couplers 38 positioned thereon. The couplers 38 each preferably comprise a female coupler having a size and shape adapted for receiving a respective one of the upper 34 or lower ends 36. As is depicted in FIG. 3, numeral indicia 40 may be positioned on the couplers 38, connectors 22 and corner members 20 for directing a person in attaching the various parts to form a frame structure.

A cage 40 includes a horizontal wall 42 and a perimeter wall 44 that is attached to and extends downwardly from the horizontal wall 42. The horizontal wall 42 has a size and shape adapted for abutting the upper support 14 such that the upper support 14 is positioned within cage 40 and the perimeter wall 44 extends downwardly therefrom. The cage 40 has openings therein less than 9 square inches. The perimeter wall has a height generally between 1 foot and 3 feet.

A plurality of wheels 46 is preferably attached to the bottom side 18 of the bottom support 12. Each of the wheels 46 is positioned on one of the corner members 20 such that each of the corner members 20 of the bottom support 12 has a wheel mounted thereon.

In use, a user of the assembly 10 attaches together the parts of the assembly to form a frame as shown in FIG. 1 and the cage 40 is positioned over the upper support 14. The assembly 10 is most likely constructed in an area where a plurality of balloons 8 is to be filled with helium. The helium filled balloons 8 may be positioned in the cage 40 so that the horizontal wall 42 prevents the balloons from floating upwardly away from the frame structure. This allows a person to blow up a plurality of balloons 8 at one time without concern for having to tie each down to prevent its loss.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A balloon holding assembly for preventing helium filled balloons from escaping, said assembly comprising:

a first rectangular shaped loop member defining a bottom support, a second rectangular shaped loop member defining an upper support, each of said upper and bottom supports having a top side and a bottom side, each of said upper and lower supports including four corner members and four connectors for removably coupling together adjacent ones of said corner members in a spaced relationship to each other, each of said connectors comprising an elongated tubular member having a first end and a second end, each of said corner members including a first female coupler and a second female coupler, said first and second female couplers being orientated generally perpendicular to each other, each of said first and second female couplers having a size and shape adapted for removably receiving one of said first or second ends of said connectors, a space bound by each of said bottom and upper supports being open;

a plurality of elongated vertical supports each having an upper end and a lower end;

a plurality of couplers being attached to each of said upper and bottom supports for removably coupling each of said upper ends to a bottom side of said upper support and said lower ends to said top side of said bottom support such that said upper support is spaced from and positioned over said bottom support, each of said couplers being attached to an associated one of said corner members such that each of said corner members has one coupler positioned thereon, each of said couplers comprising a female coupler having a size and shape adapted for receiving a respective one of said upper or lower ends, a space between adjacent ones of said vertical supports being open;

a cage including a horizontal wall and a perimeter wall being attached to and extending downwardly from said horizontal wall, said horizontal wall having a size and shape adapted for abutting said upper support such that said upper support is positioned within said cage, said cage having openings therein less than 9 square inches;

a plurality of wheels being attached to said bottom side of said bottom support, each of said wheels being positioned on one of said corner members such that each of said corner members of said bottom support has a wheel mounted thereon; and wherein helium filled balloons may be positioned in said cage such that said horizontal wall prevents the balloons from floating upwardly away from the frame.

2. A balloon holding assembly for preventing helium filled balloons from escaping, said assembly comprising:

a first rectangular shaped loop member defining a bottom support, a second rectangular shaped loop member defining an upper support, each of said upper and bottom supports having a top side and a bottom side, each of said upper and bottom supports including four corner members and four connectors for removably coupling together adjacent ones of said corner members in a spaced relationship to each other;

a plurality of elongated vertical supports each having an upper end and a lower end;

a plurality of couplers being attached to each of said upper and bottom supports for removably coupling each of said upper ends to a bottom side of said upper support and said lower ends to said top side of said bottom support such that said upper support is spaced from and positioned over said bottom support, a space between adjacent ones of said vertical supports being open;

a cage including a horizontal wall and a perimeter wall being attached to and extending downwardly from said horizontal wall, said horizontal wall having a size and shape adapted for abutting said upper support such that said upper support is positioned within said cage;

a plurality of wheels being attached to said bottom side of said bottom support; and wherein helium filled balloons may be positioned in said cage such that said horizontal wall prevents the balloons from floating upwardly away from the frame.

3. The assembly according to claim 2, wherein each of said connectors comprises an elongated tubular member having a first end and a second end.

4. The assembly according to claim 3, wherein each of said corner members includes a first female coupler and a second female coupler, said first and second female couplers being orientated generally perpendicular to each other, each of said first and second female couplers having a size and shape adapted for removably receiving one of said first or second ends of said connectors.

5. The assembly according to claim 2, wherein each of said couplers is attached to an associated one of said corner members such that each of said corner members has one coupler positioned thereon.

6. The assembly according to claim 5, wherein each of said couplers comprises a female coupler having a size and shape adapted for receiving a respective one of said upper or lower ends.

7. The assembly according to claim 2, wherein each of said wheels is positioned on one of said corner members such that each of said corner members of said bottom support has a wheel mounted thereon.

* * * * *